United States Patent [19]

Siani et al.

[11] Patent Number: 4,723,493

[45] Date of Patent: Feb. 9, 1988

[54] INFANT WALL SEAT AND CHANGING TABLE ASSEMBLY

[76] Inventors: Marie E. Siani; Vincent J. Siani; Stephen P. Rinaldi, all of 44 Coolidge Ave., Yonkers, N.Y. 10701

[21] Appl. No.: 946,336

[22] Filed: Dec. 24, 1986

Related U.S. Application Data

[63] Continuation-in-part of Ser. No. 864,016, May 16, 1986, abandoned.

[51] Int. Cl.[4] ..... A47B 3/00

[52] U.S. Cl. ..... 108/134; 108/27; 297/464

[58] Field of Search ..... 108/134, 27, 60, 112, 108/152, 77, 78, 47, 48; 297/14, 335, 464, 119, 238, 112; 312/248, 246

[56] References Cited

U.S. PATENT DOCUMENTS

| | | | |
|---|---|---|---|
| 89,776 | 5/1869 | Jones | 297/119 |
| 352,723 | 11/1886 | Weeden | 297/112 |
| 1,127,139 | 2/1915 | West | 108/2 F X |
| 3,026,158 | 3/1962 | Freeman | 108/134 X |
| 3,089,742 | 5/1963 | Powell | 108/134 X |
| 3,328,078 | 6/1967 | Whitley, Jr. | 297/464 |
| 3,837,706 | 9/1974 | Suttles | 297/464 |
| 4,632,457 | 12/1963 | Hofrichter et al. | 103/134 X |
| 4,650,252 | 3/1987 | Kassai | 297/464 X |

FOREIGN PATENT DOCUMENTS

| | | | |
|---|---|---|---|
| 3246565 | 6/1984 | Fed. Rep. of Germany | 108/27 |

*Primary Examiner*—Peter A. Aschenbrenner
*Attorney, Agent, or Firm*—Kane, Dalsimer, Kane, Sullivan and Kurucz

[57] ABSTRACT

An infant wall seat and changing table assembly is foldable between a substantially flat condition against a vertical support and a horizontal position at which it forms a changing table for the child. The assembly is further folded to form a seat for the child with constraints for maintaining the child therein. The assembly may then be returned to either the changing table position or its flat vertical position.

9 Claims, 10 Drawing Figures

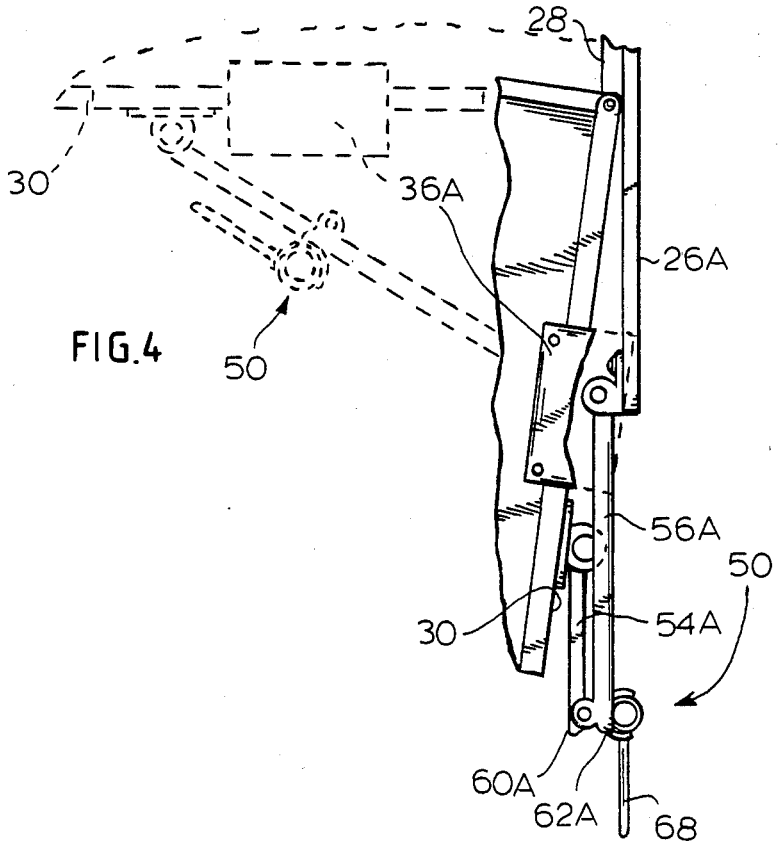
FIG.4
FIG.6
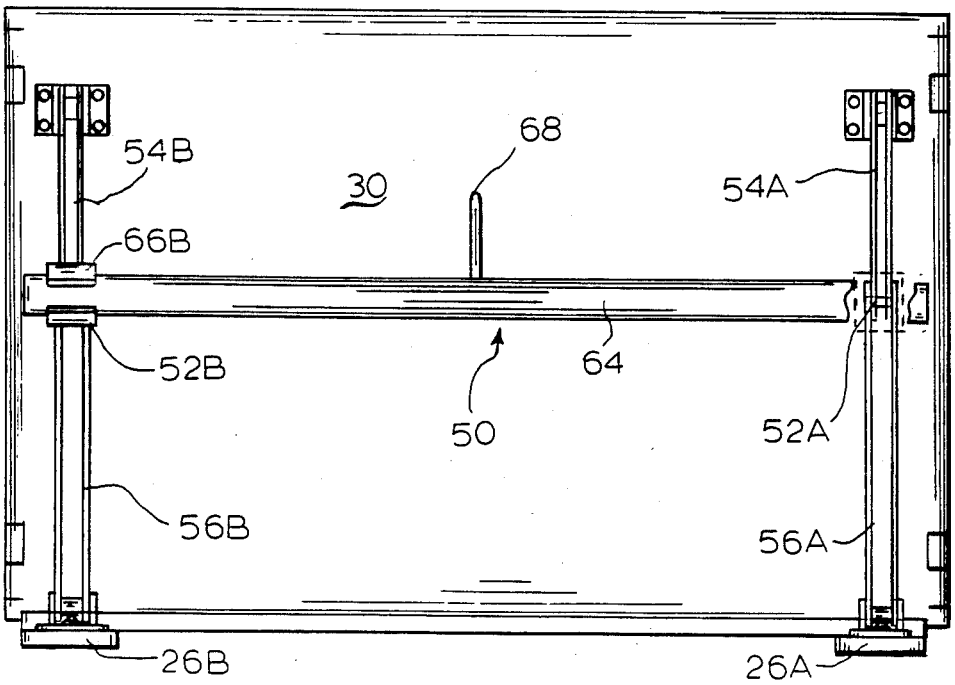

INFANT WALL SEAT AND CHANGING TABLE ASSEMBLY

This application is a continuation-in-part of application Ser. No. 864,016 filed May 16, 1986 now abandoned.

BACKGROUND OF THE INVENTION

There are times when a mother, father or parent caring for or attending to a baby, child, infant or toddler must visit public areas or rooms such as a rest room to attend to her or his needs or that of the infant, or even for purposes of changing a diaper. Experience has proven that this may be inconvenient, frustrating, and the individual may be unable to do so because of the inability to place the child with an individual other than a stranger, or secure the child safely and within view of the parent while attending to his or her needs. Public places normally do not have facilities which will permit a parent to place a child safely under his or her watchful eye while attending to his or her needs. If the child is placed in the hands or custody of a stranger, there is always the danger of kidnaping, child abuse, or harm coming to the child. Accordingly, there exists a need for the safe securement of children within public areas by parents while attending to the need of parent or child or both.

SUMMARY OF THE INVENTION

A principal object of this invention is to provide an assembly that may be installed in a public place or room such as a rest room cubicle that may be clasped or unfolded from a substantially flat condition or state against a door or wall, and may be thereafter erected or folded in a relatively easy and convenient manner to form a changing table for a child, and further folded to erect a seat for the infant in which the child may be secured while the parent attends to his or her needs while maintaining a watchful eye over the child at the same time.

Another object is to provide an assembly of the foregoing type which may be erected and collapsed into a flat condition relatively easily and without any great degree of manual dexterity, and even with one hand while the parent holds the child in the other.

A further object is to provide assembly of the foregoing type which may be easily constructed of relatively few and inexpensive parts and with mass-production techniques which would enable the assembly to be made and marketed at relatively low cost.

Other objects and advantages will become apparent in the following detailed description, which is to be taken in conjunction with the accompanying drawings in which:

FIG. 4 is side view thereof, with certain parts broken away and removed, and also showing a phantom of the assembly erected as a changing table.

FIG. 6 is a bottom view thereof with the drop-leaf also shown in phantom when shifted to the folded or seat-forming position.

DETAILED DESCRIPTION OF THE PREFERRED EMBODIMENT

Figure 7:
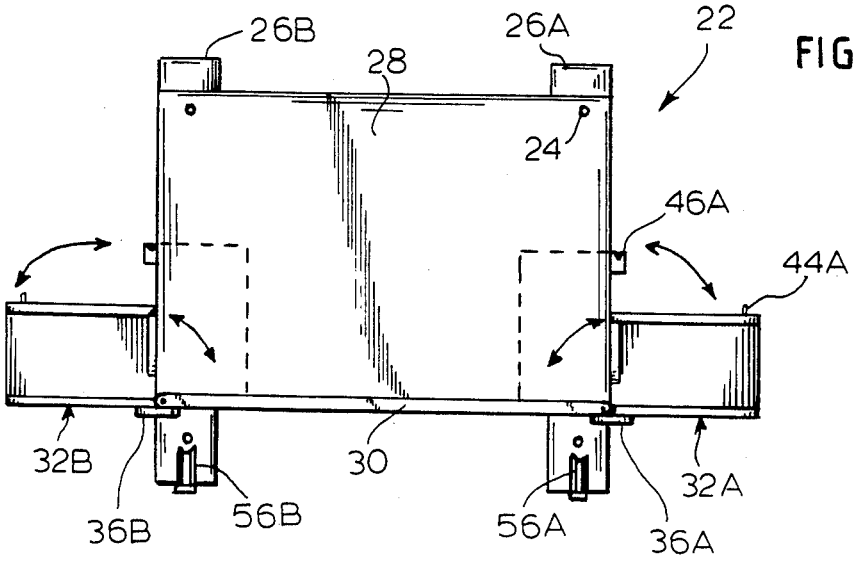
FIG. 7 is front view of the assembly in the changing table position.
Figure 10:
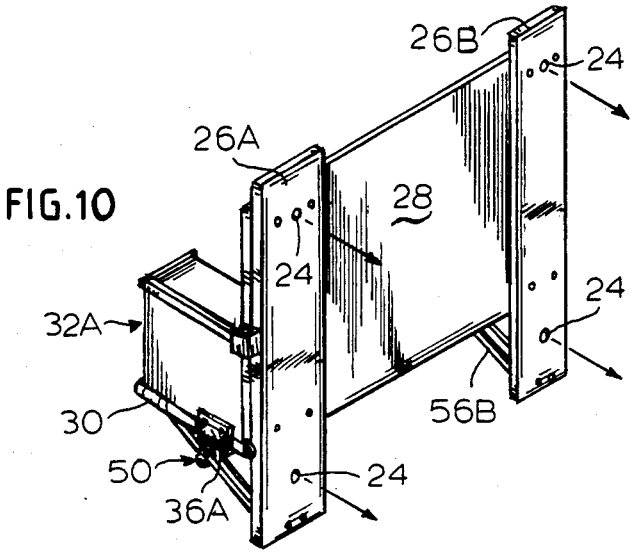
FIG. 10 is a rear perspective view of the assembly of FIG. 9.
Figure 8:
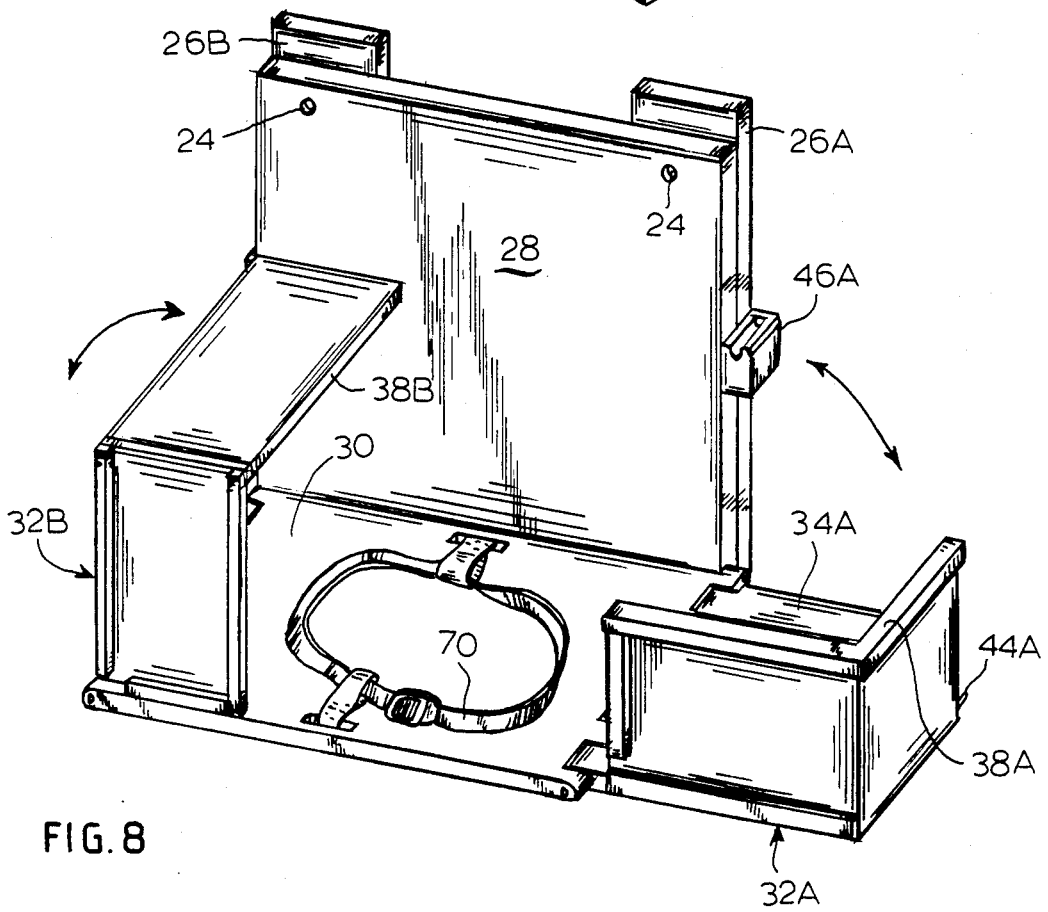
FIG. 8 is a prespective view showing the assembly being folded from the changing table position to the seat position.

Referring to the drawings, a contemplated public space such as a bathroom cubicle 20 is shown in which is hung or suitably supported, the infant wall seat and changing table are assembly 22 of the present invention. This assembly 22 is shown in the collapsed or unfolded position in which it is somewhat flush against the wall or door of the cubicle, which may be of any suitable construction for such purposes whether it be of wood, metal, plaster, drywall, etc. In this connection, the anchors or supports 24 are suitably connected to connect or anchor the assembly 22. These supports 24 extend through the vertical posts or members 26 to which is fixed the chair back panel 28. A seat panel 30 is hingedly connected to the vertical back panel 28. At each side of the seat panel 30 is pivotally mounted a drop leaf 32A, 32B which, in view of their location, are of complementary construction. Toward this end, and with a specific reference to drop leaf 32A, bottom panel 34A is directly hinged to the seat panel 30. This bottom panel 32A has a drop leaf support 36A fixed thereto and which is adapted to engage with the bottom surface of the seat panel 30 to support the drop leaf in the outwardly extending unfolded position when the seat panel 30 is pivoted to its horizontal position as shown in FIG. 7. A side railing 38A and front railing 40A are advantageously provided to prevent the child from falling out of the assembly when folded to its changing table position shown in FIG. 7. When each drop leaf is pivoted to permit the front rail 40A to rest upon the seat panel 30 as shown in FIG. 8, the child is contained in the assembly when folded to the erect infant wall seat position shown in FIG. 9. In this regard, the drop leafs are maintained in the position shown in FIG. 9 through the interconnection of a releasable latch which may assume any one of many constructions and configurations as for example, that shown in the figures which includes a rearwardly extending pin which is adapted to be forcibly placed in an accommodating recess 44A of bracket 46A secured to the vertical post 26A.

Figure 1:
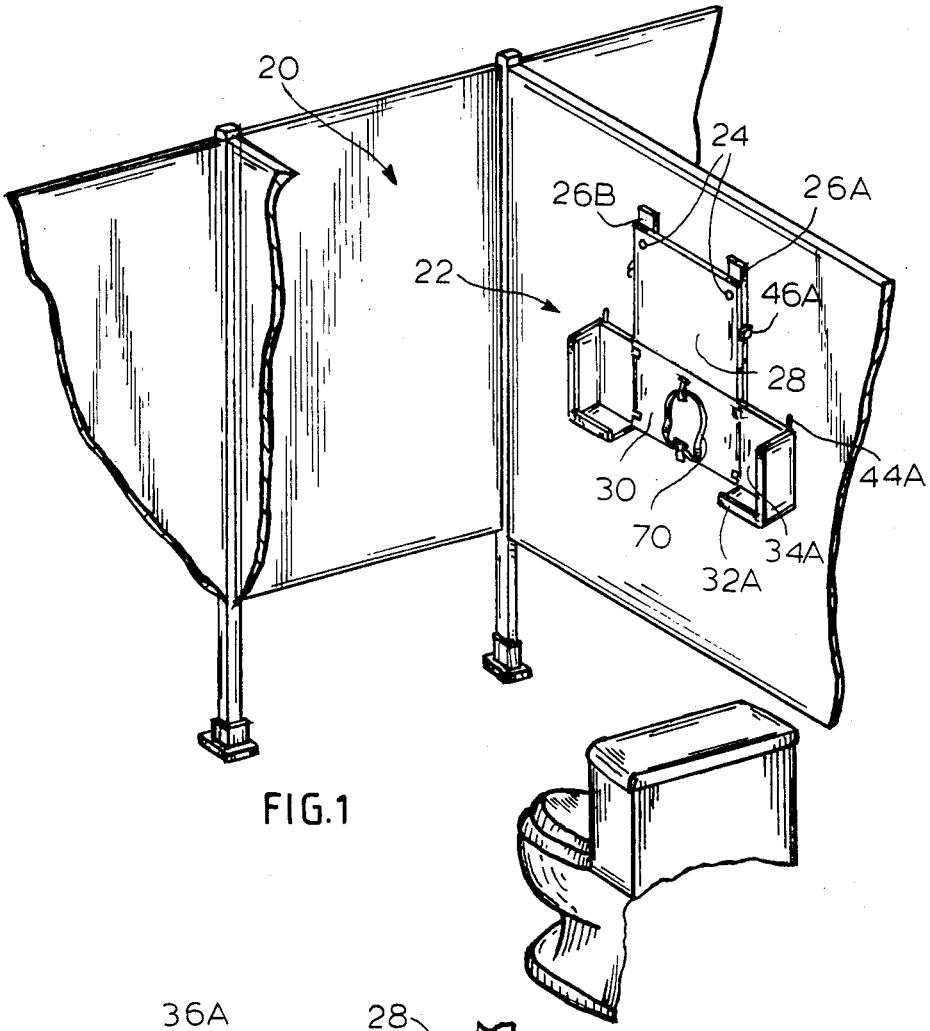
FIG. 1 is a perspective view with certain parts broken away, removed and sectioned illustrating a public space or room, more specifically, a bathroom cubicle in which the infant wall seat and changing table assembly of the present invention is mounted and shown in a collapsed and relatively flat condition.

Interconnecting the back panel 28 and the seat panel 30 to permit it to assume the fully collapsed or extended position of FIG. 1 and to permit the seat to be pivoted to its horizontal position and maintained in this position until it is desired to shift it back down to the unfolded position, is a releasable drop leaf bracket assembly 50. This bracket assembly includes a pair of spring-biased hinges 52A and 52B. Referring specifically to the hinge 52A, an upper shorter arm 54A is pivoted to the bottom of seat panel 30 at one end and at the other end pivoted to a longer arm 56A which in turn is pivoted to the lower end of the vertical post 26A. A spring 58A extends between and biases each of the arms 54A and 56A. In the position shown in FIG. 5, the edge 60A of upper arm 54A abuts against edge 62A of lower arm 56A and these edges are biased into this abutting relationship at which arms 54A and 56A are aligned by means of the interposed spring 58A. In this manner, the horizontal position of the seat panel 30 is maintained. A pipe 64 extends between each hinge 52A and 52B and is secured thereto in order that each hinge will act in unison by means of the bracket 66A secured to the end of the lower arm 56A. A handle 68 of any convenient configuration extends from the pipe 64 and permits the seat panel 30 to be shifted conveniently between the horizontal erect position of FIG. 5 and the vertical unfolded position of FIGS. 1 and 4.

Figure 9:
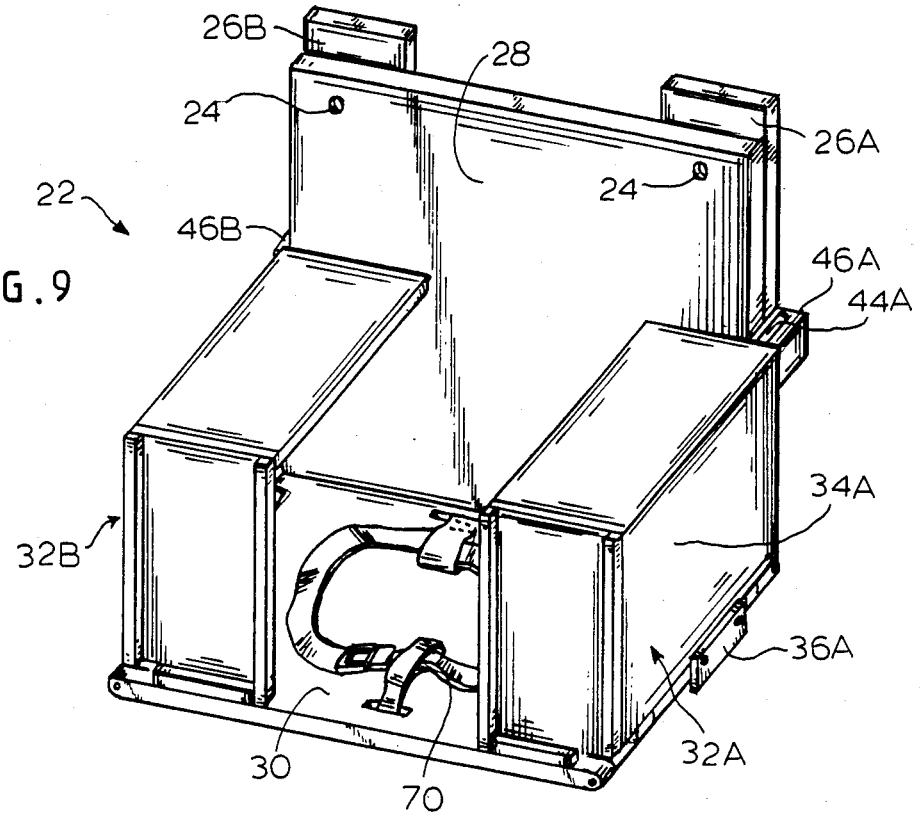
FIG. 9 is a perspective view with the assembly completely folded and erected to the seat position.

When the assembly 22 is in the fully erect infant wall seat position of FIG. 9 or in the changing table position of FIG. 7, the child may be secured in place without danger of falling by means of the strap 70 which may assume any one of many constructions which would permit it to be secured to the seat panel 30, buckled and unbuckled to permit the child to be placed in the secured position and removed therefrom.

Figure 5:
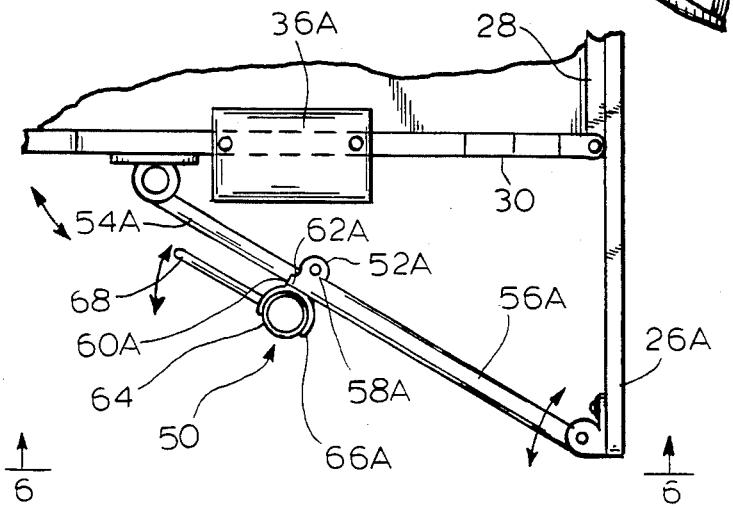
FIG. 5 is a side view showing the assembly erected in the position in which it may be deployed or used as a changing table.
Figure 2:
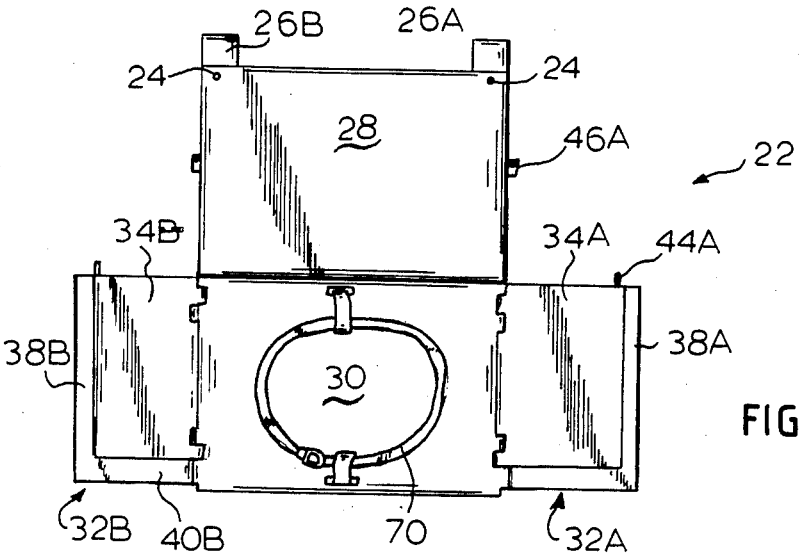
FIG. 2 is a front view thereof.
Figure 3:
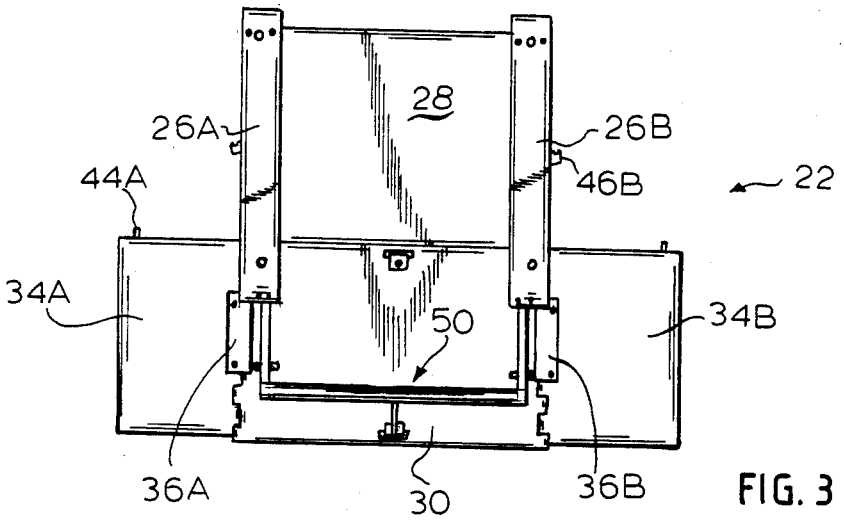
FIG. 3 is a rear view thereof.

In operation and assuming that the infant wall seat and changing table assembly 22 is in the folded vertical position of FIGS. 1 to 4, a parent desiring to place a child on a changing table for purposes of changing a diaper will grasp the seat panel 30 with one hand and pivot it or shift it vertically to the position of FIGS. 5, 6 and 7 at which the hinges pivot about each of their pivot points to place the abutting edges 60A of shorter arm 54A and edge 62A of longer arm 56A into abutting relationship and biased against one another by means of the interposed spring. In this position, the seat 30 will remain in a horizontal position until it is deliberately shifted downwardly therefrom by means of a pull downwardly by the parent on handle 68. When changing the infant's diaper, the parent may strap the child in place by means of the strap 70.

Should the parent wish to place the assembly 22 into the infant wall seat position, when the seat panel 30 is secured or locked into its horizontal position as shown in FIGS. 5, 6 and 7, the drop leafs 32A and 32B are pivoted inwardly from the position shown in FIG. 7 to that depicted in FIGS. 8 and 9. These drop leafs 32A and 32B are secured in their vertical or wall seat position by means of the selected latch assembly which in the specific disclosed embodiment is the latching of pin 42A in recess 42B of the bracket 46B. In this position, the child may be secured in place by utilizing the strap 70. When this has been accomplished, the parent may then attend to his or her needs in the public room or space whether it be a bathroom or other location.

When the parent has attended to his or her specific needs and wishes to remove the child from the assembly 22, the strap 70 is unbuckled, and the child is removed. On the other hand, should the parent wish to attend to other needs of the child, for example, changing a diaper, the drop leafs 32A and 32B may be unlatched and placed in their horizontal extended position as shown in FIGS. 5, 6 and 7. In the event the parent does not wish to utilize the assembly 22 in the changing table position, the seat panel 30 is shifted downwardly to the vertical collapsed position of FIGS. 1 to 4 simply pulling downwardly on the handle 68.

It should be understood that the back panel 28 may in fact be a vertical wall or partition on the public space or enclosure as distinct from being a separate member that is attached thereto.

The parts of the assembly 22, particularly the panel and rails, may be formed of any suitable resin material that lends itself to extrusion or molding techniques. The resin should have the ability and property of being readily cleaned and durable in nature considering the intended use, and not readily deteriorated by liquids or body wastes to which it may be subjected. Obviously metal or wood can also be used or a combination of all of these materials.

In addition, although the foregoing description is specific to the placement and mounting of the assembly 22 in public places, it should be understood that the assembly 22 may also be placed at other locations including places of public transportation, homes, etc.

Thus, the several afore-noted objects and advantages of the invention are most effectively attained. Although a single somewhat preferred embodiment of the invention has been disclosed and described in detail herein, it should be understood that it is in no sense limited thereby, and its scope is to be determined by that of the appended claims.

What is claimed is:

1. An infant wall seat and changing table assembly including a back panel, a seat panel pivotal thereto between a vertical collapsed position and a horizontal erect position, means for releasably latching the seat panel in the horizontal position, and pivoting means for permitting the assembly while the seat panel is in the horizontal position to be deployed as a changing table, and an infant wall seat, the extension means including at least one drop leaf pivotal to the seat panel between a horizontal position at which the drop leaf serves as an extension of the seat panel for purposes of forming a changing table and a vertical psoition at which the drop leaf serves to laterally restrain an infant when sitting on the seat panel, means for securing the drop leaf in the horizontal position and releasable latch means for releasably latching the drop leaf in its vertical position, the seat panel having a back edge, a front edge, and opposed side edges, the back edge being pivotal to the back panel, and said drop leaf being pivotally mounted along one side edge of the seat panel and another drop leaf is pivotally mounted on the other side edge of the seat panel, each drop leaf including a front rail and a side rail that serves as a constraint for an infant whether the assembly is used as a changing table or as a wall seat.

2. The invention in accordance with claim 1 wherein a strap means is attached to the seat panel for purposes of securing a child in place whether the assembly is used as a changing table or a wall seat.

3. An infant wall seat and changing table assembly including a substantially vertical back panel and a collapsed substantially vertically seat panel pivotally connected to the back panel, the seat panel having a back edge and opposed side edges with the back edge pivotally connected to the back panel and a drop leaf pivotally connected to the seat panel along each of its side edges and being disposed in a substantially vertical position, the seat panel adapted to be shifted between the vertical position and a horizontal position and simultaneously move with it each of the drop leafs, latch means for releasably latching the seat panel and consequently the drop leafs in the horizontal position in which the assembly is adapted to serve as a changing table, and the seat panel is adapted to be unlatched and shifted from its horizontal position back to its vertical position and consequently shift with it the drop leafs to the vertical position, the drop leafs begin pivotal to a vertical position when the seat panel is in a horizontal position at which the drop leaf serves to laterally restrain an infant when sitting on the seat panel, means for securing the drop leaf in the horizontal position and releasable latch means for releasably latching the drop leaf in its vertical position, each drop leaf including a front rail and a side rail that serves as a constraint for an infant whether the assembly is used as a changing table or as a wall seat.

4. The invention in accordance with claim 3 wherein a strap means is attached to the seat panel for purposes of securing a child in place whether the assembly is used as a changing table or a wall seat.

5. An infant wall seat and changing table assembly including a substantially vertical back panel and a collapsed substantially vertical seat panel pivotally connected to the back panel, the seat panel having a back edge and opposed side edges with the back edge pivotally connected to the back panel and a drop leaf pivotally connected to the seat panel along each of its side edges and being disposed in a substantially vertical position, the seat panel adapted to be shifted between the vertical position and a horizontal position and simultaneously move with it each of the drop leafs, latch means for releasably latching the seat panel, and the seat panel is adapted to be unlatched and shifted from its horizontal position back to its vertical position and consequently shift with it the drop leafs to the vertical position, the drop leafs being pivotal to a vertical position when the seat panel is in a horizontal position at which the drop leafs serve to laterally restrain an infant when sitting in the seat panel, restraining means on the seat panel and drop leafs for restraining an infant on the assembly when the assembly is used as a changing table and when it is used as a wall seat.

6. The invention in accordance with claim 5 wherein means are provided for securing the drop leafs in the horizontal position and releasable latch means for releasably latching the drop leaf in its vertical position.

7. The invention in accordance with claim 5 wherein a strap means is attached to the seat panel for purposes of securing a child in place whether the assembly is used as a changing table or a wall seat.

8. The invention in accordance with claim 5, wherein a cubical is provided having a wall, and the infant wall seat and changing table assembly is hung from the cubical wall.

9. An infant wall seat and hanging table assembly including a substantially vertical back panel and a collapsed substantially vertical seat panel pivotally connected to the back panel, the seat panel having a back edge and opposed side edges with the back edge pivotally connected to the back panel and a drop leaf pivotally connected to the seat panel along each of its side edges and being disposed in a substantially vertical position, the seat panel adapted to be shifted between the vertical position and a horizontal position and simultaneously move with it each of the drop leafs, latch means for releasably latching the seat panel, and the seat panel is adapted to be unlatched and shifted from its horizontal position back to its vertical position and consequently shift with it the drop leafs to the vertical position, the drop leafs being pivotal to a vertical position when the seat panel is in a horizontal position at which the drop leafs serve to laterally restrain an infant when sitting in the seat panel, means being provided for securing the drop leafs in the horizontal position and releasable latch means for releasably latching the drop leaf in its vertical position, each drop leaf including a front rail and a side rail that serves as a constraint for an infant whether the assembly is used as a changing table or as a wall seat.

* * * * *